US010258155B2

(12) United States Patent
Chen et al.

(10) Patent No.: US 10,258,155 B2
(45) Date of Patent: Apr. 16, 2019

(54) MOVEMENT CONTROL DEVICE FOR PART ASSEMBLY

(71) Applicants: King Slide Works Co., Ltd., Kaohsiung (TW); King Slide Technology Co., Ltd., Kaohsiung (TW)

(72) Inventors: Ken-Ching Chen, Kaohsiung (TW); Hsiu-Chiang Liang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 15/873,013

(22) Filed: Jan. 17, 2018

(65) Prior Publication Data

US 2018/0368573 A1 Dec. 27, 2018

(30) Foreign Application Priority Data

Jun. 23, 2017 (TW) ..... 106121326 A

(51) Int. Cl.

*A47B 88/46* (2017.01)
*A47B 88/50* (2017.01)
*E05B 65/46* (2017.01)

(52) U.S. Cl.

CPC ..... *A47B 88/50* (2017.01); *A47B 88/46* (2017.01); *E05B 65/46* (2013.01); *A47B 2210/0094* (2013.01)

(58) Field of Classification Search

CPC ..... A47B 88/50; A47B 88/46; A47B 88/456; A47B 88/443

See application file for complete search history.

(56) References Cited

U.S. PATENT DOCUMENTS 4,441,772 A * 4/1984 Fielding ..... A47B 88/57 312/330.1
4,872,734 A * 10/1989 Rechberg ..... A47B 88/493 312/333
4,998,828 A * 3/1991 Hobbs ..... A47B 88/493 312/334.46
5,033,805 A * 7/1991 Hobbs ..... A47B 88/493 312/333
5,580,138 A * 12/1996 Grabher ..... A47B 88/467 312/319.1
6,296,338 B1 * 10/2001 Stijns ..... A47B 88/493 312/333
6,550,827 B1 4/2003 Tsujino
6,764,149 B2 * 7/2004 Jurja ..... A47B 88/57 312/333

(Continued)

*Primary Examiner* — Daniel J Rohrhoff

(74) *Attorney, Agent, or Firm* — Alan D. Kamrath; Kamrath IP Lawfirm, P.A.

(57) ABSTRACT

A movement control device is applicable to a first object and a second object movable relative to the first object. One of the first object and the second object is arranged with a first blocking part and a second blocking part, and the other one of the first object and the second object is movably arranged with a blocking member. When the second object is moved relative to the first object and the blocking member is moved from an initial position to a blocking position, the blocking member is configured to block one of the first blocking part and the second blocking part, in order to prevent the second object from being moved relative to the first object.

12 Claims, 13 Drawing Sheets

(56) References Cited

U.S. PATENT DOCUMENTS

| | | | | |
|---|---|---|---|---|
| 6,796,625 | B2 * | 9/2004 | Lauchner | H05K 5/0013 312/333 |
| 6,997,528 | B2 * | 2/2006 | Yang | A47B 88/467 312/319.1 |
| 8,172,345 | B2 | 5/2012 | Liang et al. | |
| 10,100,972 | B2 * | 10/2018 | Chen | A47B 88/473 |
| 2002/0021061 | A1 * | 2/2002 | Lammens | A47B 88/43 312/334.44 |
| 2006/0043851 | A1 * | 3/2006 | Lee | A47B 88/467 312/333 |

* cited by examiner

MOVEMENT CONTROL DEVICE FOR PART ASSEMBLY

BACKGROUND OF THE INVENTION

1. Field of the Invention

The present invention relates to a movement control device, and more particularly, to a movement control device capable of controlling relative movement between a movable object and a fixed object.

2. Description of the Prior Art

Generally, when a movable object, such as a furniture part (a drawer, a cabinet, a door, and the like) or a device encounters an earthquake (or is hit or tilted), a movable member of the furniture part or the device may be automatically opened relative to a fixed member due to a shaking force or a tilt angle during the earthquake being too large. Therefore, for safety reasons, related products have been developed. For example, U.S. Pat. No. 6,550,827 B1 discloses a closing device of hinged door. The door comprises a main body (31), a hinged door (32), a case (33), a locking body (38) and at least one spherical body (37). Wherein, the at least one spherical body (37) is arranged on an upper surface of the locking body (38), so as to stop the locking body (38) from moving upward at the time of earthquake in order to control the hinged door (32) to a degree that it can be opened slightly.

On the other hand, U.S. Pat. No. 8,172,345 B2 of Liang et al. discloses a slide rail assembly having push-open and self-closing functions. Wherein, a drawer can be mounted to a cabinet through a pair of slide rail assemblies. When the drawer is retracted into the cabinet, an obvious pushing gap is formed between a front panel of the drawer and the cabinet. The pushing gap allows a user to push the drawer to move relative to the cabinet, such that the drawer can be opened relative to the cabinet by a push-ejection mechanism arranged on the slide rail assembly. However, when the drawer system is shook, tilted or hit, the drawer of such drawer system with the push-open function may be ejected out unintentionally, so as to cause damage to people or object.

There are various kinds of furniture parts or devices in living space. Therefore, it is important to prevent a moving object from causing damage to people when the furniture parts or devices are shook, tilted or hit.

SUMMARY OF THE INVENTION

The present invention relates to a movement control device for a part assembly capable of preventing a second object from being unexpectedly opened relative to a first object when a shock, tilt, or collision occurs.

According to an embodiment of the present invention, a movement control device is applicable to a first object and a second object movable relative to the first object. The movement control device comprises a first blocking member, a supporting plate, and a second blocking member. The first blocking member is arranged on one of the first object and the second object. The first blocking member comprises a first blocking part and a second blocking part. The supporting plate is fixed to the other one of the first object and the second object. The second blocking member is arranged on the supporting plate and movable relative to the supporting plate between an initial position and a blocking position. Wherein, when the second object is moved relative to the first object along a first direction and the second blocking member is moved from the initial position to the blocking position, the second blocking member is configured to block one of the first blocking part and the second blocking part, in order to prevent the second object from being moved relative to the first object along the first direction.

Preferably, when the second object is moved relative to the first object to a predetermined position along a second direction opposite to the first direction, the other one of the first blocking part and the second blocking part contacts the second blocking member, in order to move the second blocking member away from the blocking position.

Preferably, the second blocking member has a stopping feature corresponding to the first blocking member.

Preferably, a space is defined between the first blocking part and the second blocking part.

Preferably, the blocking position of the second blocking member is in the space.

Preferably, the movement control device further comprises a first part fixed to the supporting plate, a second part movably arranged on the supporting plate, and an actuating member arranged between the first part and the second part. Wherein, the actuating member is configured to be moved from a first position to a second position in response to relative movement between the first part and the second part, in order to drive the second blocking member to move from the initial position to the blocking position.

Preferably, a direction of the relative movement between the first part and the second part is different from a direction of the actuating member being moved from the first position to the second position.

Preferably, the second blocking member has a guiding section corresponding to the actuating member. The actuating member is configured to drive the second blocking member to move from the initial position to the blocking position through the guiding section.

Preferably, the guiding section of the second blocking member has an inclined surface or an arc surface.

Preferably, the actuating member is a ball.

According to another embodiment of the present invention, a part assembly comprises a first object and a second object movable relative to the first object. Wherein, one of the first object and the second object is arranged with a first blocking part and a second blocking part. Wherein, the other one of the first object and the second object is movably arranged with a blocking member. Wherein, when the second object is moved relative to the first object and the blocking member is moved from an initial position to a blocking position, the blocking member is configured to block one of the first blocking part and the second blocking part, in order to prevent the second object from being moved relative to the first object.

Preferably, the first object is a fixed rail and the second object is a movable rail.

Preferably, the first object is a fixed furniture part and a second object is a movable furniture part.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
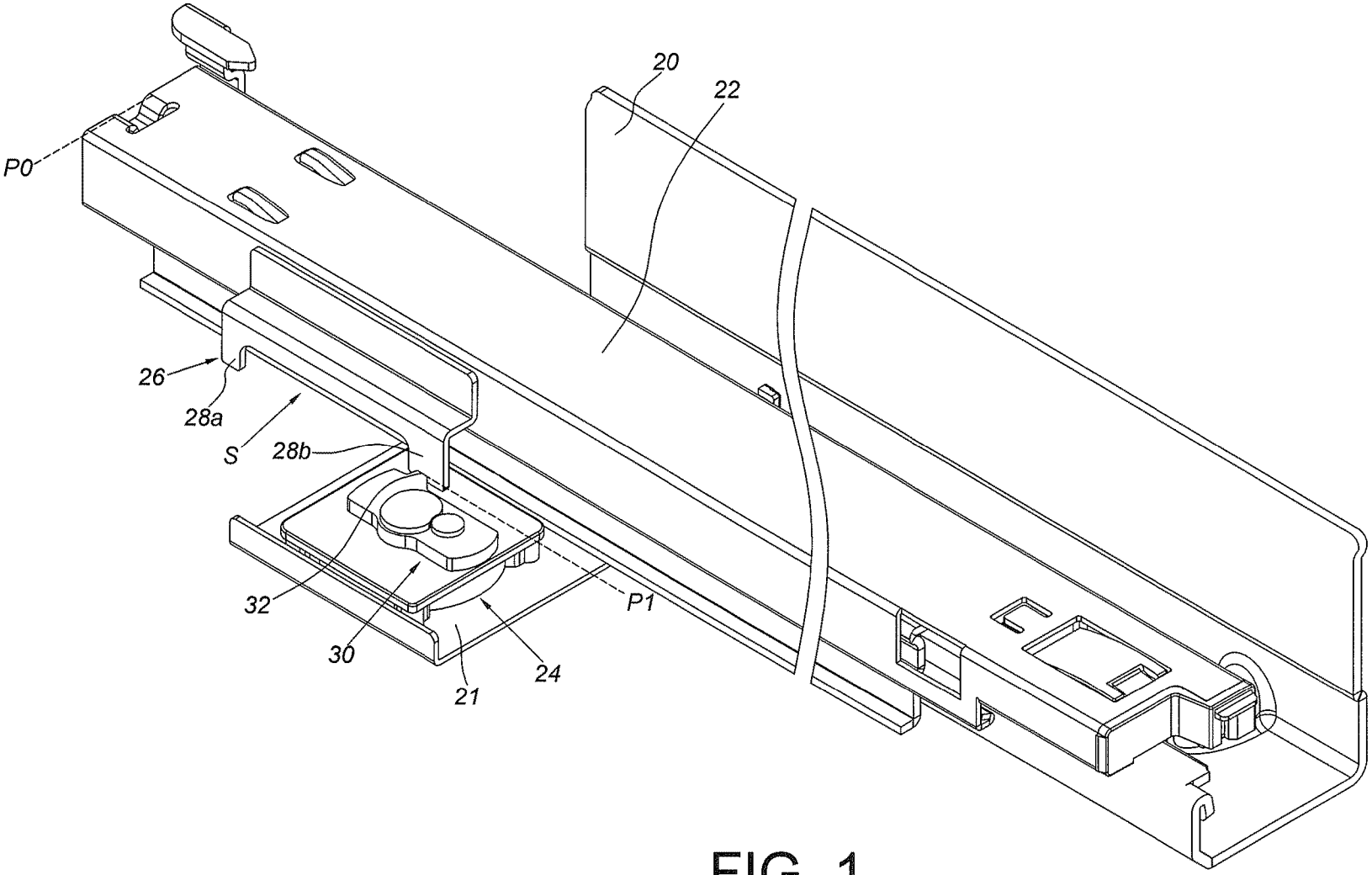
FIG. 1 is a diagram showing a movement control device applied to a slide rail assembly according to an embodiment of the present invention.

FIG. 1 is a diagram showing a movement control device 24 for a part assembly according to an embodiment of the present invention. The part assembly comprises a first object 20, and a second object 22 movable relative to the first object 20. As shown in FIG. 1, the second object 22 is located at a predetermined position P0 (such as a closed position) relative to the first object 20. One of the first object 20 and the second object 22 is arranged with a first blocking part 28*a* and a second blocking part 28*b*. In an embodiment of the present invention, the movement control device 24 comprises a first blocking member 26, a second blocking member 30 and a supporting plate 21. The first blocking member 26 is arranged on one of the first object 20 and the second object 22. In the present embodiment, the first blocking member 26 is fixedly arranged on the second object 22. The first blocking member 26 has the first blocking part 28*a* and the second blocking part 28*b*. A space S is defined between the first blocking part 28*a* and the second blocking part 28*b* of the first blocking member 26. The other one of the first object 20 and the second object 22 is arranged with a second blocking member 30. In an embodiment of the present invention, the first object 20 is fixedly connected to the supporting plate 21, and the second blocking member 30 is movable relative to the supporting plate 21, such that the second blocking member 30 can be seen to be movably arranged on the first object 20. In the present embodiment, the second blocking member 30 has a stopping feature 32 corresponding to the first blocking member 26. Moreover, the second blocking member 30 is located at an initial position P1.

Preferably, the first object 20 is a fixed rail and the second object 22 is a movable rail.

Figure 2:
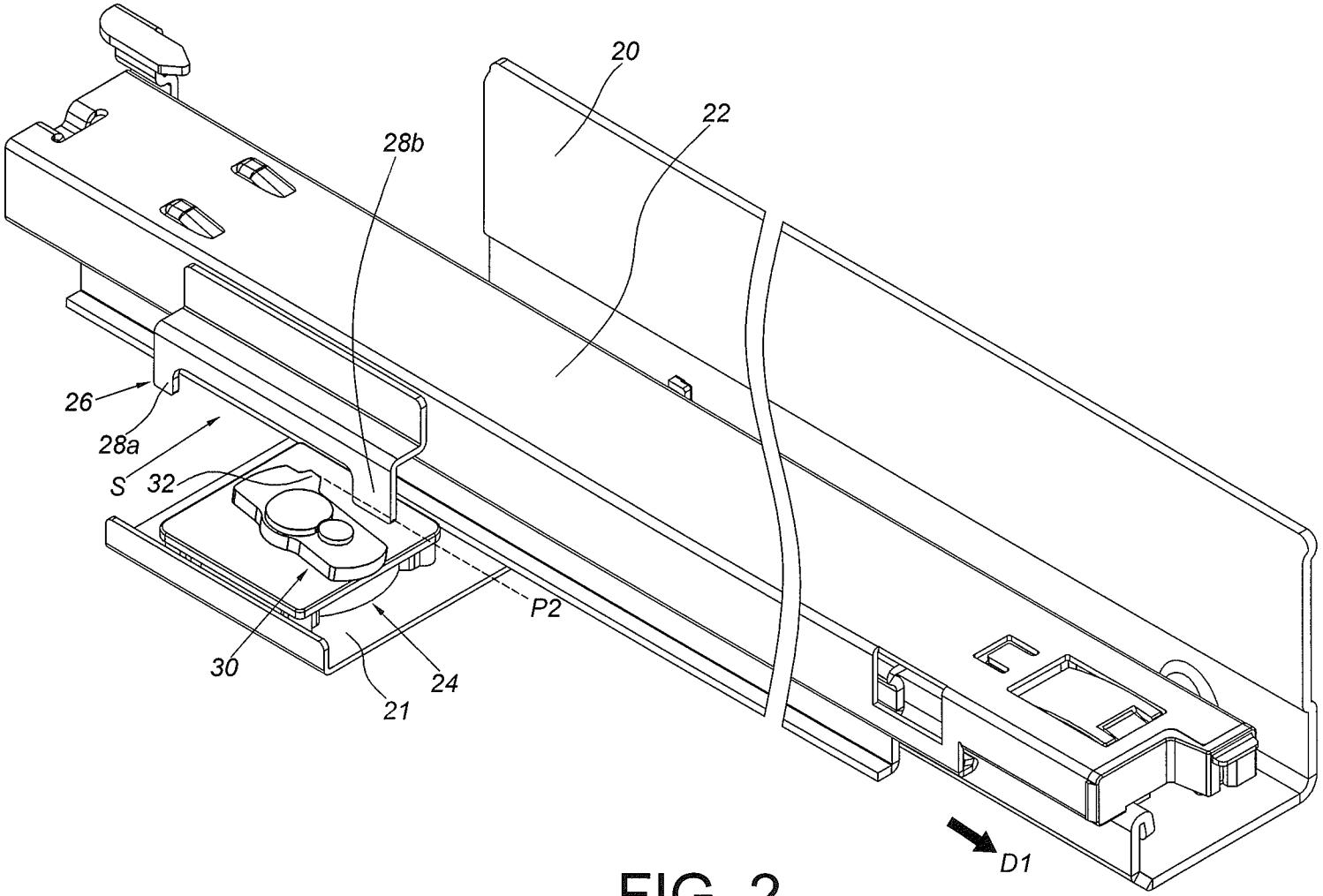
FIG. 2 is a diagram showing movement of the movement control device and the slide rail assembly when the slide rail assembly is shook or tilted.
Figure 3:
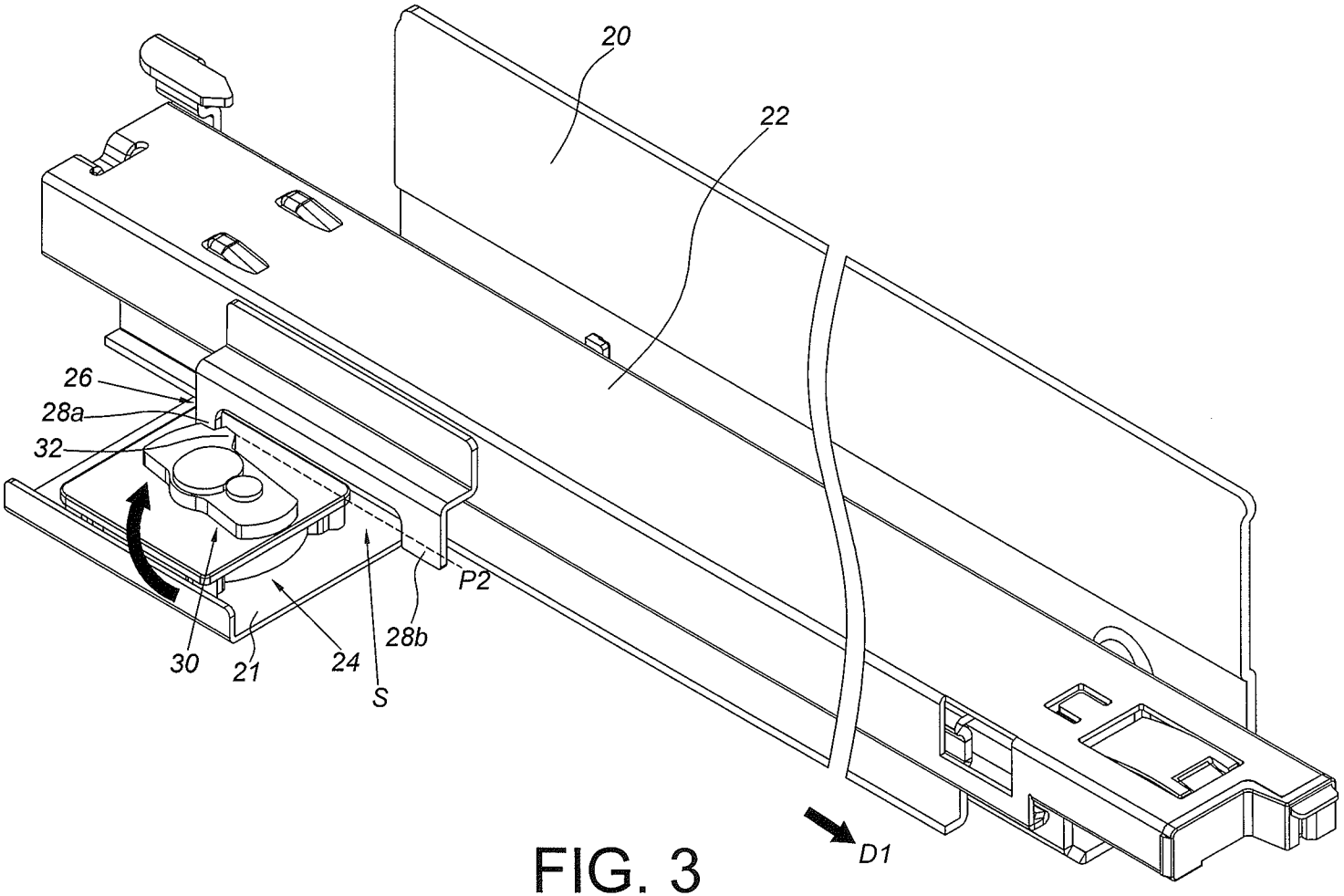
FIG. 3 is a diagram showing the movement control device configured to prevent the slide rail assembly from being moved when the slide rail assembly is shook or tilted.

As shown in FIG. 2 and FIG. 3, when the part assembly is shook or tilted, the second object 22 is moved relative to the first object 20 along a first direction D1 accordingly. On the other hand, the second blocking member 30 is also moved from the initial position P1 to a blocking position P2 due to the part assembly being shook or tilted. The blocking position P2 of the second blocking member 30 is in the space S. Wherein, when the second blocking member 30 is located at the blocking position P2, the stopping feature 32 of the second blocking member 30 is configured to block one of the first blocking part 28*a* and the second blocking part 28*b* of the first blocking member 26. In the present embodiment, the stopping feature 32 of the second blocking member 30 is configured to block the first blocking part 28*a* of the first blocking member 26, in order to prevent the second object 22 from being further moved relative to the first object 20 along the first direction D1.

Figure 4:
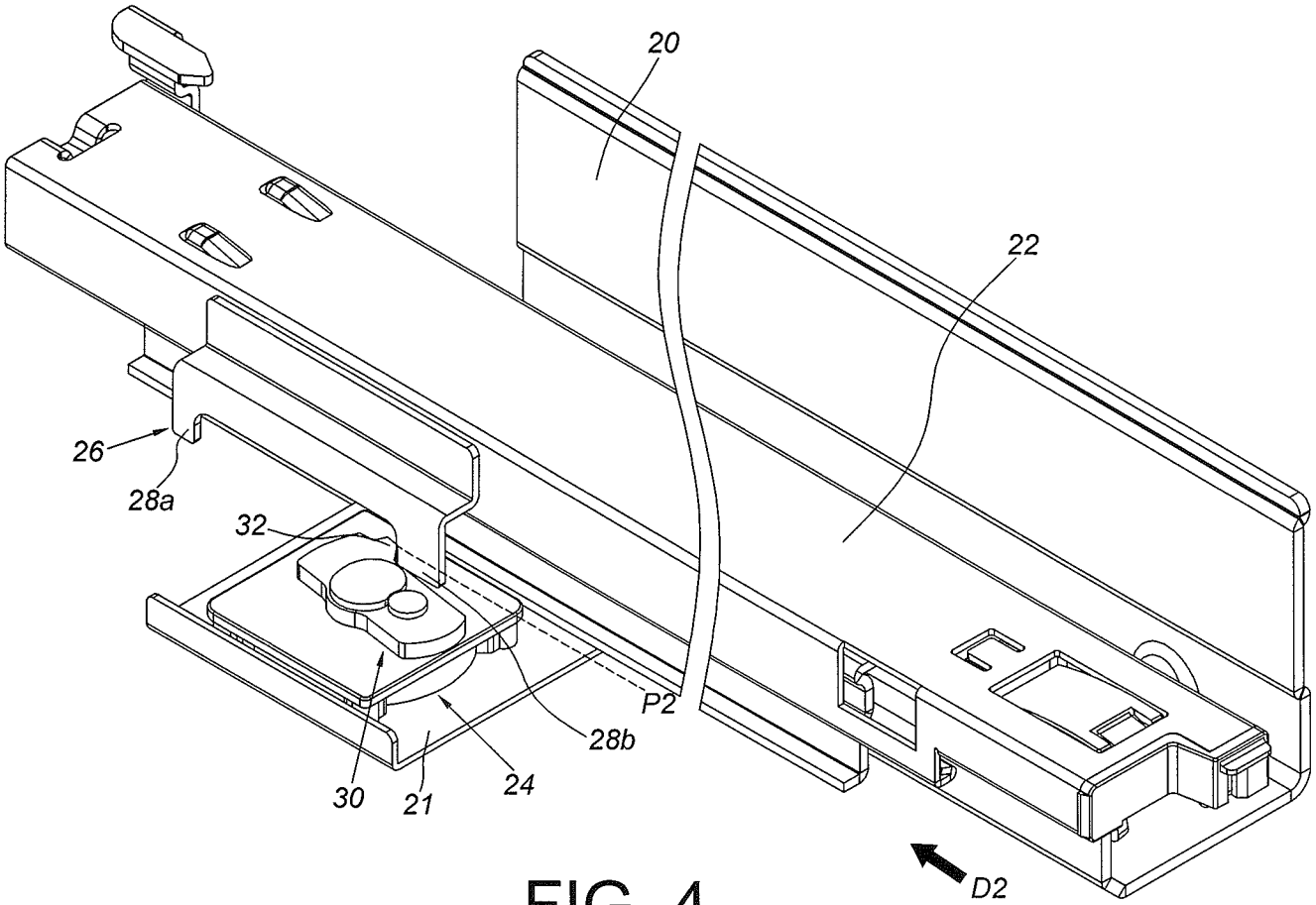
FIG. 4 is a diagram showing a process of the slide rail assembly returning to an initial position when the slide rail assembly is no longer shook or tilted.

When the part assembly is no longer shook or tilted and the second blocking member 30 still stays at the blocking position P2, the second object 22 can be moved by an external force relative to the first object 20 to the predetermined position P0 (the closed position) along a second direction D2 (opposite to the first direction D1). During such process, the second blocking member 30 contacts the other one of the first blocking part 28*a* and the second blocking part 28*b* of the first blocking member 26. As shown in FIG. 4, in the present embodiment, the second blocking member 30 contacts the second blocking part 28*b* of the first blocking member 26. When the second object 22 is further moved relative to the first object 20 along the second direction D2, the second blocking member 30 is pushed by the second blocking part 28*b* of the first blocking member 26 to move away from the blocking position P2 and return to the initial position P1 shown in FIG. 1. When the second blocking member 30 returns to the initial position P1, the second blocking member 30 no longer blocks the first blocking member 26, such that the second object 22 can be freely moved relative to the first object 20 along the first direction D1. In other words, the second object 22 can be completely opened or expanded relative to the first object 20.

Figure 5:
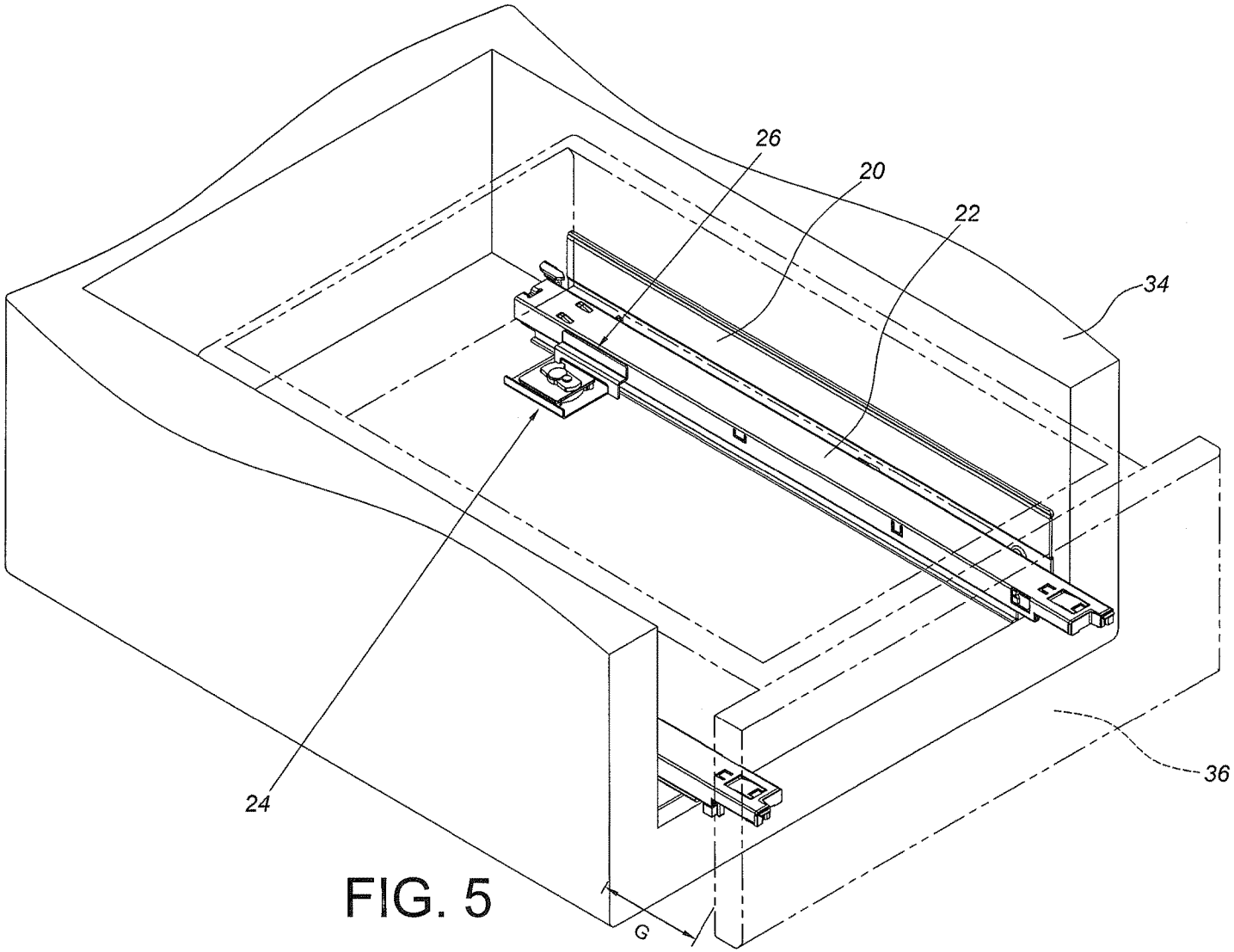
FIG. 5 is a diagram showing the movement control device and the slide rail assembly being applied to a drawer system according to an embodiment of the present invention, wherein a drawer is slightly opened relative to a fixed cabinet only with a gap in between when the drawer system is shook or tilted.

Therefore, the movement control device of the present invention can be apply to a furniture system (such as a drawer system) shown in FIG. 5. The furniture system comprises a fixed furniture part 34 (such as a fixed cabinet), and a movable furniture part 36 (such as a drawer). Wherein, the first object 20 can be a fixed rail fixedly mounted to the fixed furniture part 34, and the second object 22 can be a movable rail mounted to the movable furniture part 36. When the furniture system is shook or tilted, the movable furniture part 36 is slightly opened relative to the fixed furniture part 34 only with a gap G in between, in order to prevent an article from falling out of the movable furniture part 36.

Figure 6:
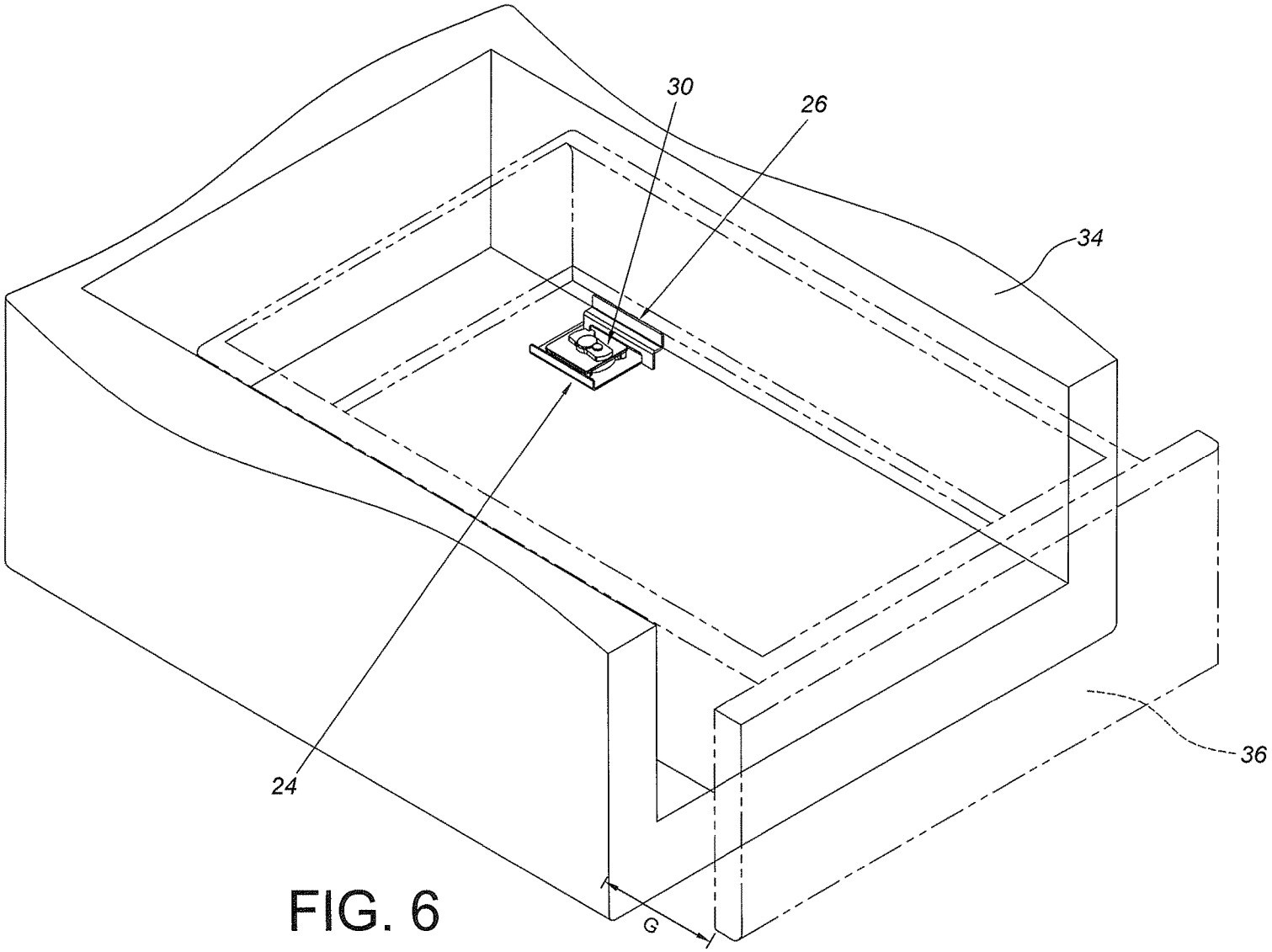
FIG. 6 is a diagram showing the movement control device being applied to the drawer system according to an embodiment of the present invention, wherein the drawer is slightly opened relative to the fixed cabinet only with a gap in between when the drawer system is shook or tilted.

As shown in FIG. 6, in another embodiment, the first object 20 can be the fixed furniture part 34 (such as a drawer cabinet), and the second object 22 can be the movable furniture part 36 (such as the drawer). The first blocking member 26 of the movement control device 24 is arranged on the movable furniture part 36, and the second blocking member 30 is arranged on the fixed furniture part 34. When the furniture system is shook or tilted, the movable furniture part 36 is also slightly opened relative to the fixed furniture part 34 only with the gap G in between, in order to prevent the article from falling out of the movable furniture part 36.

Figure 7:
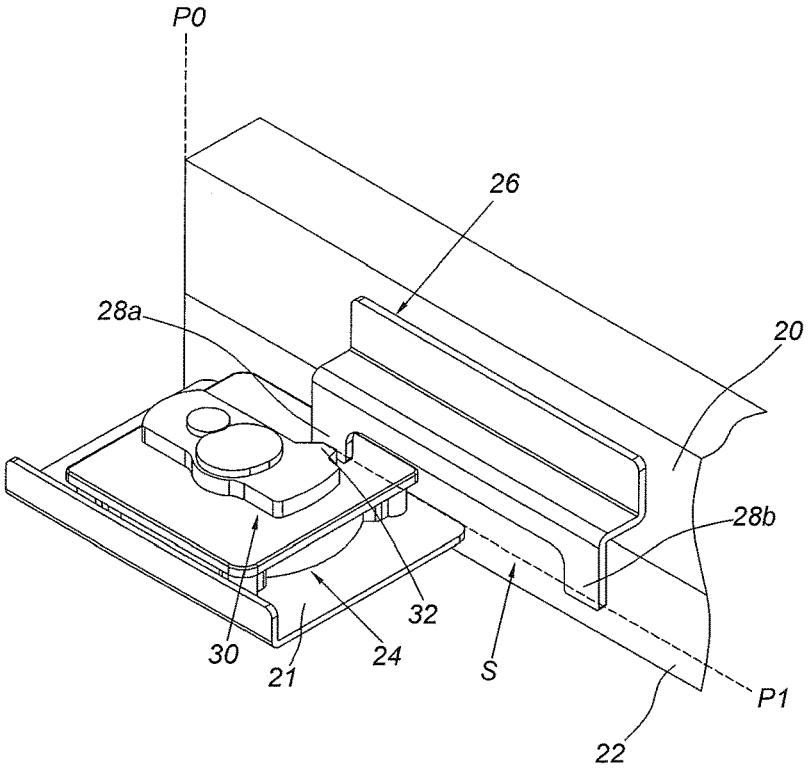
FIG. 7 is a diagram showing the movement control device being applied to the slide rail assembly according to another embodiment of the present invention.

FIG. 7 shows another embodiment of the present invention. Similarly, the second object 22 is movable relative to the first object 20, and the second object 22 is located at the predetermined position P0 (such as the closed position) relative to the first object 20. In the present embodiment, the first blocking member 26 is fixedly arranged on the first object 20. The first blocking member 26 has the first blocking part 28*a* and the second blocking part 28*b*, and the space S is defined between the first blocking part 28*a* and the second blocking part 28*b* of the first blocking member 26. In the present embodiment, the second object 22 is fixedly connected to the supporting plate 21, and the second blocking member 30 is movable relative to the supporting plate 21, such that the second blocking member 30 can be seen to be movably arranged on the second object 22. In the present embodiment, the second blocking member 30 has the stopping feature 32. Moreover, the second blocking member 30 is located at the initial position P1.

Figure 8:
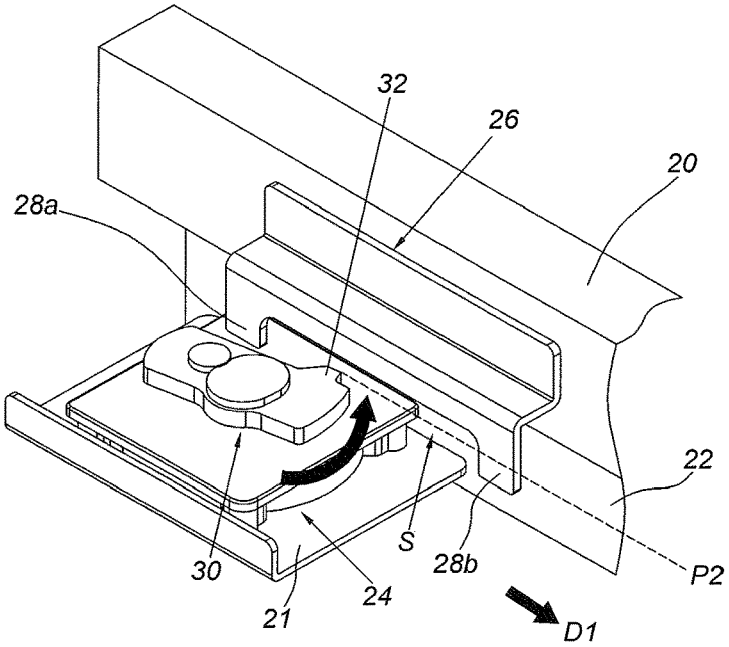
FIG. 8 is a diagram showing movement of the movement control device and the slide rail assembly when the slide rail assembly is shook or tilted according to another embodiment of the present invention.
Figure 9:
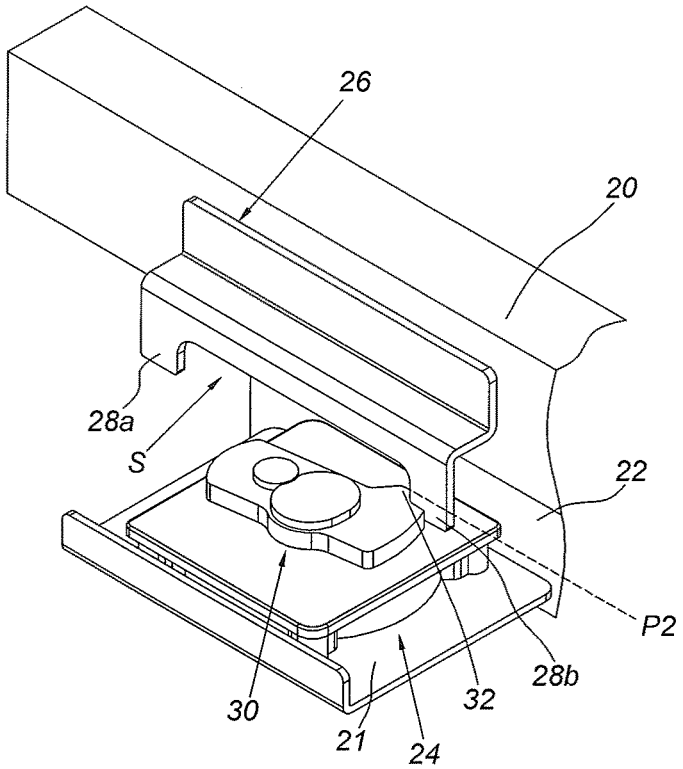
FIG. 9 is a diagram showing the movement control device configured to prevent the slide rail assembly from being moved when the slide rail assembly is shook or tilted according to another embodiment of the present invention.

As shown in FIG. 8 and FIG. 9, when the part assembly is shook or tilted, the second object 22 is moved relative to the first object 20 along the first direction D1 accordingly. On the other hand, the second blocking member 30 is also moved from the initial position P1 to the blocking position P2 due to the part assembly is shook or tilted. The blocking position P2 of the second blocking member 30 is in the space S. Wherein, when the second blocking member 30 is located at the blocking position P2, the stopping feature 32 of the second blocking member 30 is configured to block one of the first blocking part 28*a* and the second blocking part 28*b* of the first blocking member 26. In the present embodiment, the stopping feature 32 of the second blocking member 30 is configured to block the second blocking part 28*b* of the first blocking member 26, in order to prevent the second object 22 from being further moved relative to the first object 20 along the first direction D1.

Figure 10:
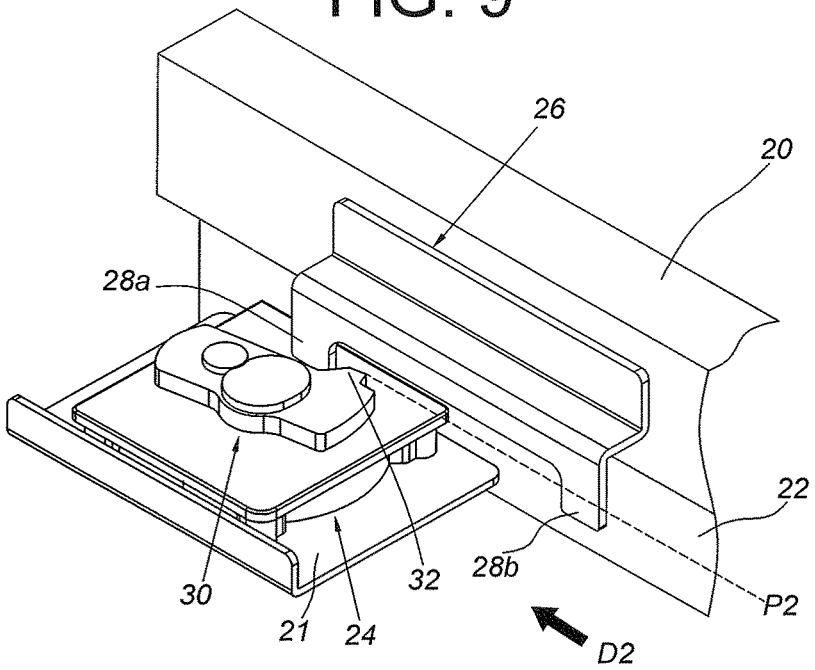
FIG. 10 is a diagram showing a process of the slide rail assembly returning to the initial position when the slide rail assembly is no longer shook or tilted according to another embodiment of the present invention.

When the part assembly is no longer shook or tilted and the second blocking member 30 still stays at the blocking position P2, the second object 22 can be moved by an external force relative to the first object 20 to the predetermined position P0 (the closed position) along the second direction D2. During such process, the second blocking member 30 contacts the other one of the first blocking part 28*a* and the second blocking part 28*b* of the first blocking member 26. As shown in FIG. 10, in the present embodiment, the second blocking member 30 contacts the first blocking part 28*a* of the first blocking member 26. When the second object 22 is further moved relative to the first object 20 along the second direction D2, the second blocking member 30 is pushed by the first blocking part 28*a* of the first blocking member 26 to move away from the blocking position P2 and return to the initial position P1 shown in FIG. 7. When the second blocking member 30 returns to the initial position P1, the second blocking member 30 no longer blocks the first blocking member 26, such that the second object 22 can be freely moved relative to the first object 20 along the first direction D1. In other words, the second object 22 can be completely opened or expanded relative to the first object 20.

Figure 11:
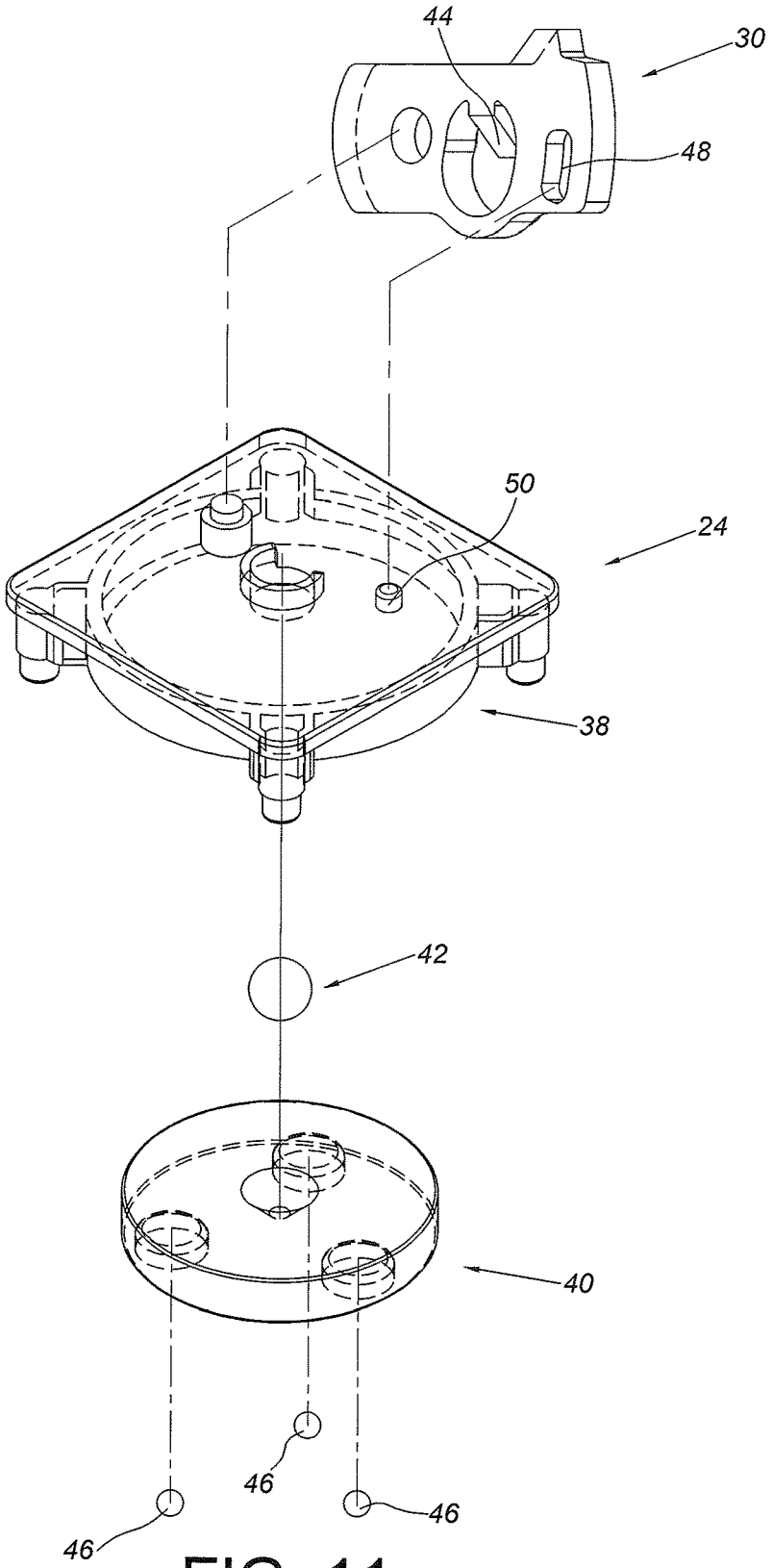
FIG. 11 is an exploded view of the movement control device according to an embodiment of the present invention.
Figure 12:
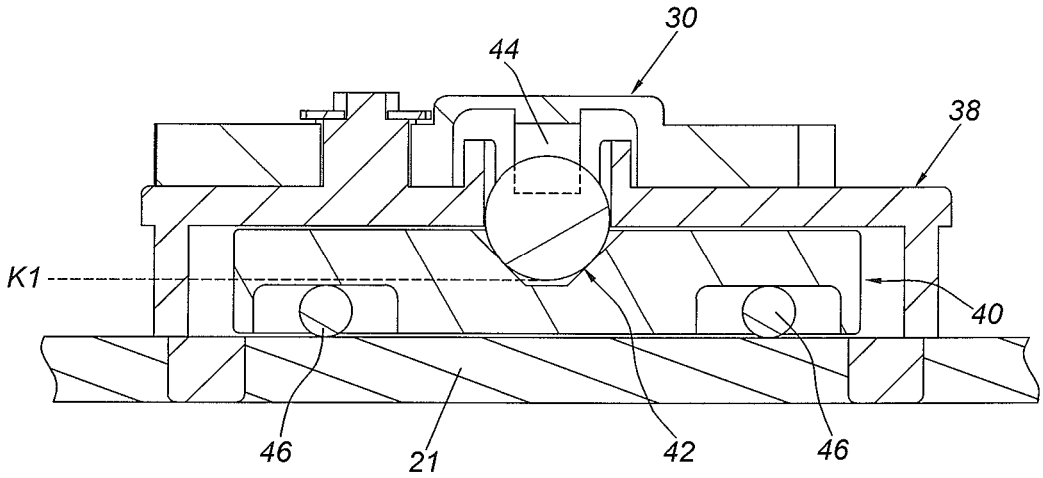
FIG. 12 is a diagram showing the movement control device before being activated according to an embodiment of the present invention.
Figure 13:
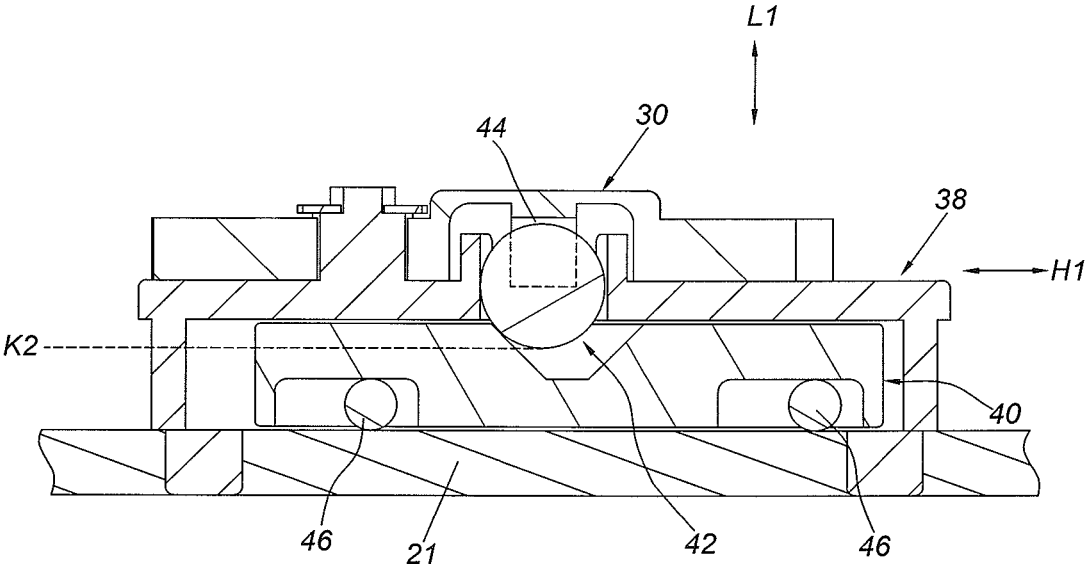
FIG. 13 is a diagram showing the movement control device after being activated according to an embodiment of the present invention.

Preferably, the movement control device 24 of the present invention can be implemented by a mechanical mechanism. As shown in FIG. 11 to FIG. 13, the movement control device 24 further comprises a first part 38 fixed to the supporting plate 21, a second part 40 movably arranged on the supporting plate 21, and an actuating member 42 arranged between the first part 38 and the second part 40. Wherein, when the movement control device 24 is shook or tilted, a direction of relative movement between the first part 38 and the second part 40 is different from a direction of the actuating member 42 being moved from a first position K1 to a second position K2. In the present embodiment, the direction of relative movement between the first part 38 and the second part 40 is a horizontal direction H1, and the direction of movement of the actuating member 42 is a vertical direction L1. The actuating member 42 can be a ball or other spherical objects, but the present invention is not limited thereto. In addition, the second blocking member 30 has a guiding section 44 corresponding to the actuating member 42. The actuating member 42 is configured to drive the second blocking member 30 to move from the initial position P1 to the blocking position P2 through the guiding section 44. Preferably, the guiding section 44 of the second blocking member 30 has an inclined surface or an arc surface. The second blocking member 30 is movably arranged on the first part 38. Preferably, the second blocking member 30 has a bounded first mounting part 48 greater than a second mounting part 50 of the first part 38, and the first mounting part 48 and the second mounting part 50 are arranged correspondingly, such that the second blocking member 30 is movable relative to the first part 38 within a limited space. A plurality of rolling members 46 can be arranged between the second part 40 and the supporting plate 21, in order to facilitate relative movement between the first part 38 and the second part 40. According to such arrangement, the actuating member 42 can be moved from the first position K1 to the second position K2 in response to the relative movement between the first part 38 and the second part 40, in order to further drive the second blocking member 30 to move. However, the aforementioned movement control device 24 is only an embodiment of the present invention. The present invention is not limited thereto. The movement control device of the present invention can also be implemented by different designs (mechanical or non-mechanical).

Figure 14:
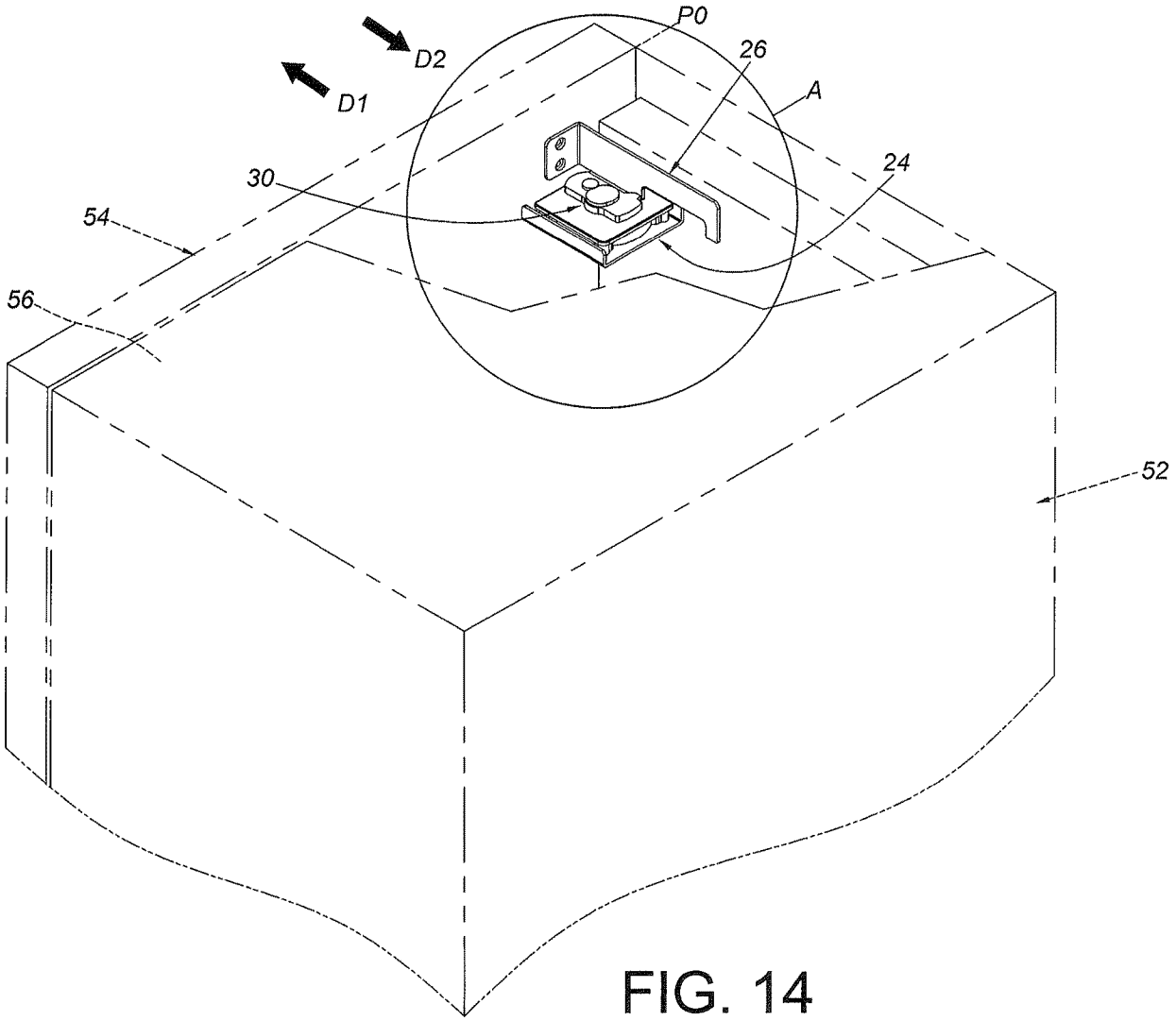
FIG. 14 is a diagram showing the movement control device being applied to a door and a cabinet of a cabinet system according to an embodiment of the present invention.
Figure 15:
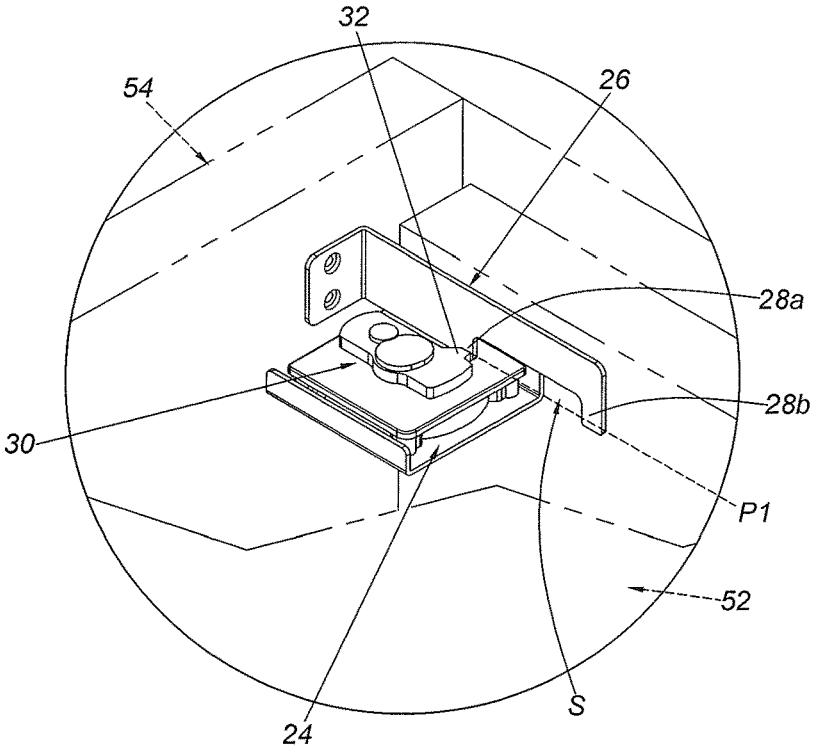
FIG. 15 is an enlarged view of an area A of FIG. 14.

As shown in FIG. 14 and FIG. 15, in another embodiment, the first object 20 can be another type of fixed furniture part 52 (such as a fixed cabinet), and the second object 22 can be another type of movable furniture part 54 (such a door plate). FIG. 14 is a diagram showing the movable furniture part 54 being located at a predetermined position P0 (such as a closed position) relative to the fixed furniture part 52.

Wherein, the movable furniture part 54 can be opened relative to the fixed furniture part 52 along a first direction D1 (such as an open direction), or can be closed relative to the fixed furniture part 52 along a second direction D2 (such as a close direction). The first blocking member 26 of the movement control device 24 is arranged on the movable furniture part 54, such as being arranged at a position adjacent to an upper edge of the movable furniture part 54. The second blocking member 30 is arranged on the fixed furniture part 52, such as being arranged on a top plate 56 of the fixed furniture part 52. The first blocking member 26 of the movement control device 24 has the first blocking part 28*a* and the second blocking part 28*b*. The space S is defined between the first blocking part 28*a* and the second blocking part 28*b* of the first blocking member 26. The second blocking member 30 has the stopping feature 32. Moreover, the second blocking member 30 is located at the initial position P1.

Figure 16:
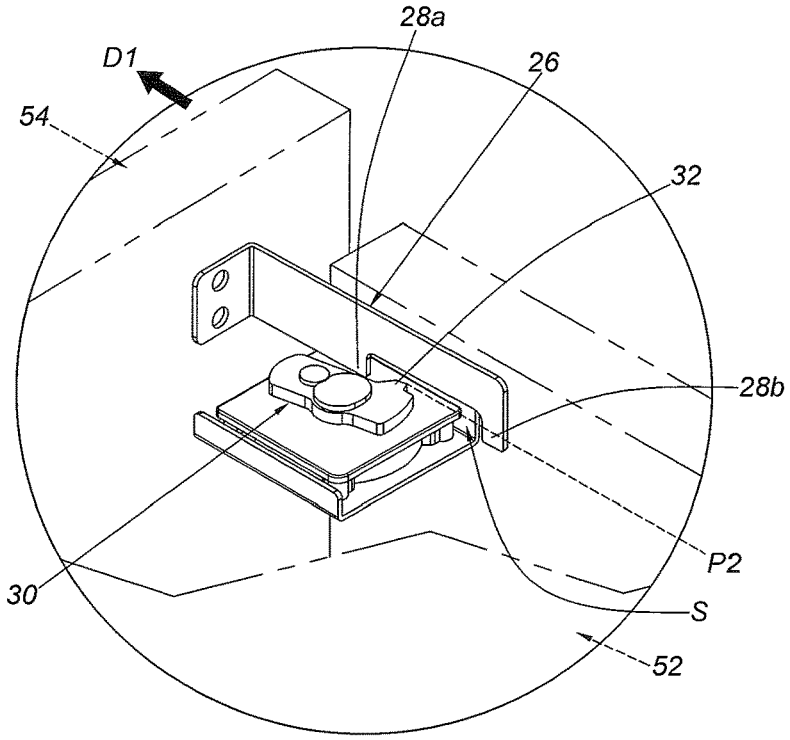
FIG. 16 is a diagram showing the door being slightly opened relative to the cabinet and the movement control device being activated when the cabinet system is shook or tilted.
Figure 17:
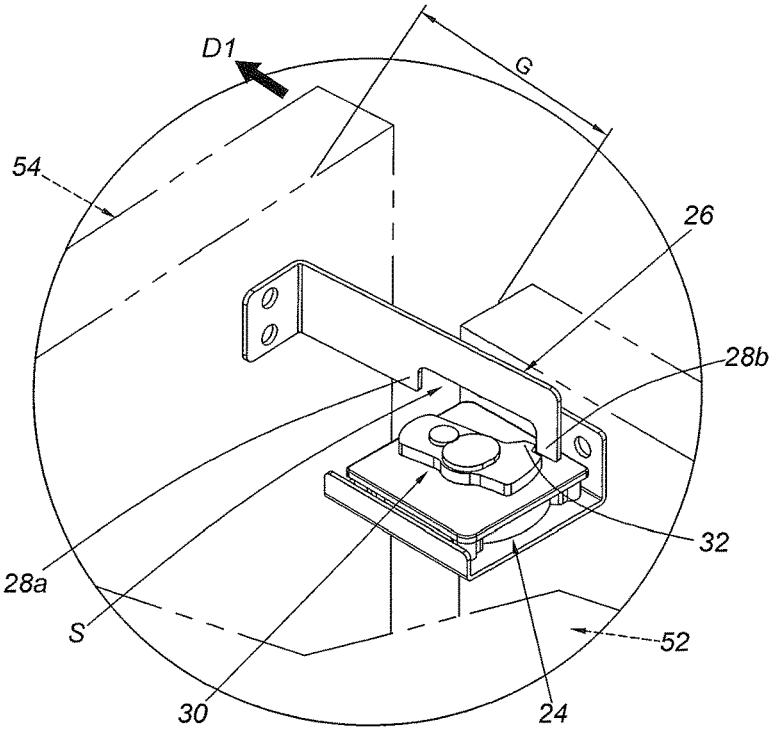
FIG. 17 is a diagram showing the movement control device configured to prevent the door from being further opened when the cabinet system is shook or tilted.

As shown in FIG. 16 and FIG. 17, when the furniture system is shook or tilted, the movable furniture part 54 is opened relative to the fixed furniture part 52 along the first direction D1 (the open direction) accordingly. On the other hand, the second blocking member 30 is moved from the initial position P1 to the blocking position P2 due to the furniture system is shook or tilted. The blocking position P2 of the second blocking member 30 is in the space S. Wherein, when the second blocking member 30 is located at the blocking position P2, the stopping feature 32 of the second blocking member 30 is configured to block one of the first blocking part 28*a* and the second blocking part 28*b* of the first blocking member 26. In the present embodiment, the stopping feature 32 of the second blocking member 30 is configured to block the second blocking part 28*b* of the first blocking member 26, in order to prevent the movable furniture part 54 from being further opened relative to the fixed furniture part 52. Therefore, the movable furniture part 54 is slightly opened relative to the fixed furniture part 52 only with a gap G in between, in order to prevent an article from falling out of the movable furniture part 54.

Figure 18:
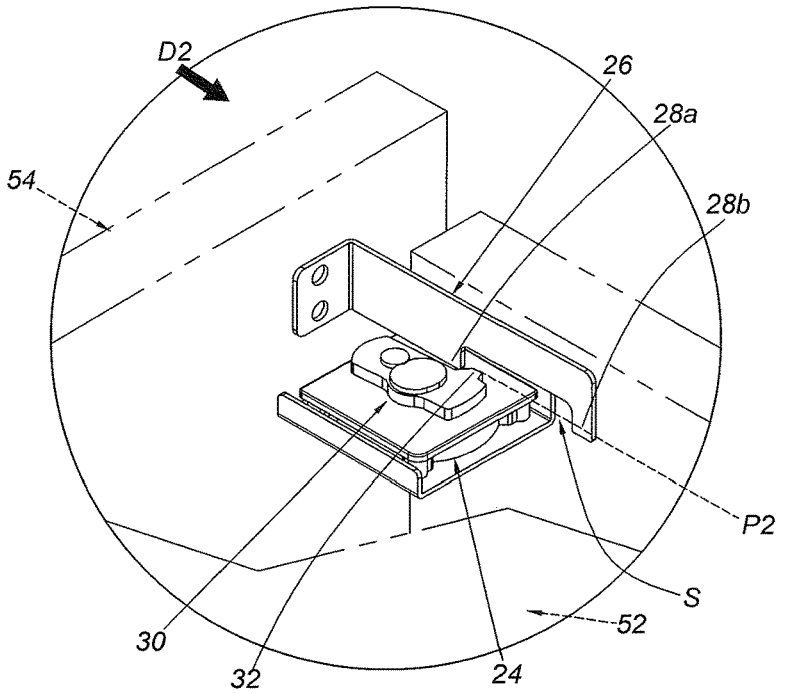
FIG. 18 is a diagram showing the door being closed relative to the cabinet when the cabinet system is no longer shook or tilted.

When the furniture system is no longer shook or tilted and the second blocking member 30 still stays at the blocking position P2, the movable furniture part 54 can be moved by an external force relative to the fixed furniture part 52 to the predetermined position P0 (the closed position) along the second direction D2 (the close direction). During such process, the second blocking member 30 contacts the other one of the first blocking part 28*a* and the second blocking part 28*b* of the first blocking member 26. As shown in FIG. 18, in the present embodiment, the second blocking member 30 contacts the first blocking part 28*a* of the first blocking member 26. When the movable furniture part 54 is further moved relative to the fixed furniture part 52 along the second direction D2, the second blocking member 30 is pushed by the first blocking part 28*a* of the first blocking member 26 to move away from the blocking position P2 and return to the initial position P1 shown in FIG. 14 and FIG. 15.

Therefore, the movement control device of the present invention is characterized in that the movement control device is configured to provide instant protection when a movable object is shook or tilted, in order to prevent any unexpected damage. Especially, when the movement control device is applied to an ejection type movable object, such as a push-open drawer, the movement control device of the present invention can prevent unexpected ejection of the movable object due to the movable object being hit, shook or tilted, in order to avoid damage to people or object.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A movement control device, applicable to a first object and a second object movable relative to the first object, the movement control device comprising:

a first blocking member arranged on one of the first object and the second object, the first blocking member comprising a first blocking part and a second blocking part;

a supporting plate fixed to the other one of the first object and the second object;

a second blocking member arranged on the supporting plate and movable relative to the supporting plate between an initial position and a blocking position;

a first part fixed to the supporting plate;

a second part movably arranged on the supporting plate, and an actuating member arranged between the first part and the second part;

wherein the actuating member is configured to be moved from a first position to a second position in response to relative movement between the first part and the second part, in order to drive the second blocking member to move from the initial position to the blocking position;

wherein when the second object is moved relative to the first object along a first direction and when the second blocking member is moved from the initial position to the blocking position, the second blocking member is configured to block one of the first blocking part and the second blocking part, in order to prevent the second object from being moved relative to the first object along the first direction.

2. The movement control device of claim 1, wherein when the second object is moved relative to the first object to a predetermined position along a second direction opposite to the first direction, the other one of the first blocking part and the second blocking part contacts the second blocking member, in order to move the second blocking member away from the blocking position.

3. The movement control device of claim 1, wherein the second blocking member has a stopping feature corresponding to the first blocking member.

4. The movement control device of claim 1, wherein a space is defined between the first blocking part and the second blocking part.

5. The movement control device of claim 4, wherein the blocking position of the second blocking member is in the space.

6. The movement control device of claim 1, wherein a direction of the relative movement between the first part and the second part is different from a direction of the actuating member being moved from the first position to the second position.

7. The movement control device of claim 1, wherein the second blocking member has a guiding section corresponding to the actuating member, the actuating member is configured to drive the second blocking member to move from the initial position to the blocking position through the guiding section.

8. The movement control device of claim 7, wherein the guiding section of the second blocking member has an inclined surface or an arc surface.

9. The movement control device of claim 7, wherein the actuating member is a ball.

10. A part assembly, comprising:

a first object;

a second object movable relative to the first object, wherein one of the first object and the second object is arranged with a first blocking part and a second blocking part, wherein the other one of the first object and the second object is fixedly arranged with a supporting plate;

a blocking member movably arranged on the supporting plate;

a first part fixed to the supporting plate;

a second part movably arranged on the supporting plate; and an actuating member arranged between the first part and the second part, wherein the actuating member is configured to be moved from a first position to a second position in response to relative movement between the first part and the second part, in order to drive the blocking member to move from an initial position to a blocking position, and wherein when the second object is moved relative to the first object and when the blocking member is moved from the initial position to the blocking position, the blocking member is configured to block one of the first blocking part and the second blocking part, in order to prevent the second object from being moved relative to the first object.

11. The part assembly of claim 10, wherein the first object is a fixed rail, and the second object is a movable rail.

12. The part assembly of claim 10, wherein the first object is a fixed furniture part, and the second object is a movable furniture part.

* * * * *